United States Patent [19]

Pfanstiel

[11] Patent Number: 5,016,782

[45] Date of Patent: May 21, 1991

[54] DISPENSER FOR VISCOUS MATERIALS

[76] Inventor: Erich Pfanstiel, Haus Nr. 3, D-7853 Steinen-Kirchhausen, Fed. Rep. of Germany

[21] Appl. No.: 365,423

[22] Filed: Jun. 13, 1989

[30] Foreign Application Priority Data

Jun. 16, 1988 [DE] Fed. Rep. of Germany ... 8807843[U]
Jun. 16, 1988 [DE] Fed. Rep. of Germany ... 8807844[U]

[51] Int. Cl.[5] ..... G01F 11/00

[52] U.S. Cl. ..... 222/257; 222/381; 222/391

[58] Field of Search ..... 222/309, 378–379, 222/381, 386, 391, 256–257

[56] References Cited

U.S. PATENT DOCUMENTS

| | | | |
|---|---|---|---|
| 1,285,186 | 11/1918 | Horwitz | 222/162 |
| 4,452,382 | 6/1984 | Von Holdt | 222/529 |
| 4,479,592 | 10/1984 | Rusing et al. | 222/319 |
| 4,506,810 | 3/1985 | Goncalves | 222/391 |
| 4,630,757 | 12/1986 | Yano | 222/79 |
| 4,749,105 | 6/1988 | Derksen | 222/80 |
| 4,848,598 | 7/1989 | McKinney | 222/391 |

FOREIGN PATENT DOCUMENTS

| | | | |
|---|---|---|---|
| 2611644 | 9/1977 | Fed. Rep. of Germany . | |
| 262982 | 1/1978 | Fed. Rep. of Germany . | |
| 7908402 | 6/1979 | Fed. Rep. of Germany . | |
| 3104726 | 8/1982 | Fed. Rep. of Germany . | |
| 3113491 | 1/1983 | Fed. Rep. of Germany . | |
| 3226835 | 1/1984 | Fed. Rep. of Germany . | |
| 3526804 | 1/1987 | Fed. Rep. of Germany . | |
| 3545743 | 6/1987 | Fed. Rep. of Germany . | |
| 361839 | 12/1987 | Fed. Rep. of Germany | 222/391 |
| 855717 | 5/1940 | France . | |
| 2185538 | 7/1987 | United Kingdom | 222/391 |

*Primary Examiner*—Kevin P. Shaver
*Assistant Examiner*—Gregory L. Huson
*Attorney, Agent, or Firm*—Peter K. Kontler

[57] ABSTRACT

A dispenser for viscous materials has a cylindrical housing with an open end, a hollow cylinder which is reciprocable in the housing and defines a chamber for viscous material. One end of the chamber is adjacent a wall member of the cylinder which is provided with an outlet for viscous material, and the other end of the chamber is adjacent a piston which is mounted on a guide of the housing and is movable with the cylinder only in a direction to extract the cylinder from the housing. The wall member serves to move the entire cylinder in a direction to move the wall member toward the piston and to thereby expel material from the chamber, and the tubular wall of the cylinder adjacent the wall member is used to pull the cylinder in the opposite direction whereby the tubular wall of the cylinder entrains the piston so that the effective volume of the chamber for viscous material remains unchanged during movement of the cylinder in the opposite direction.

24 Claims, 2 Drawing Sheets

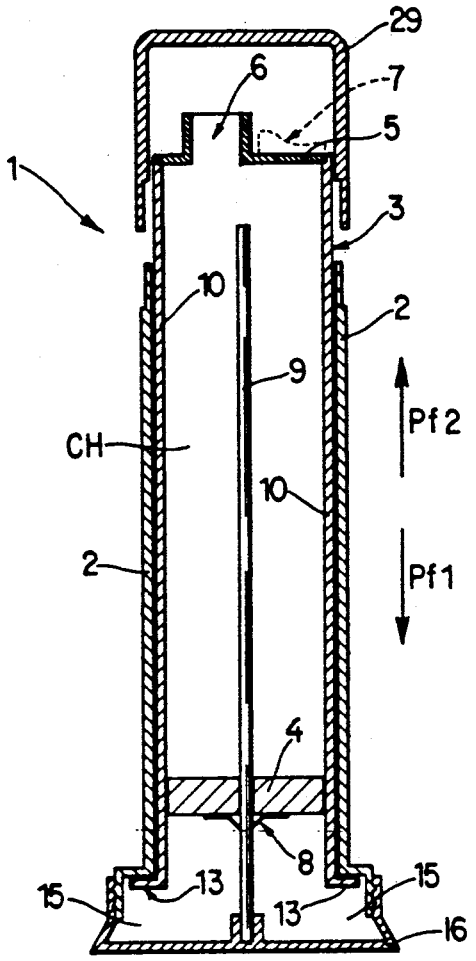
Fig. 1
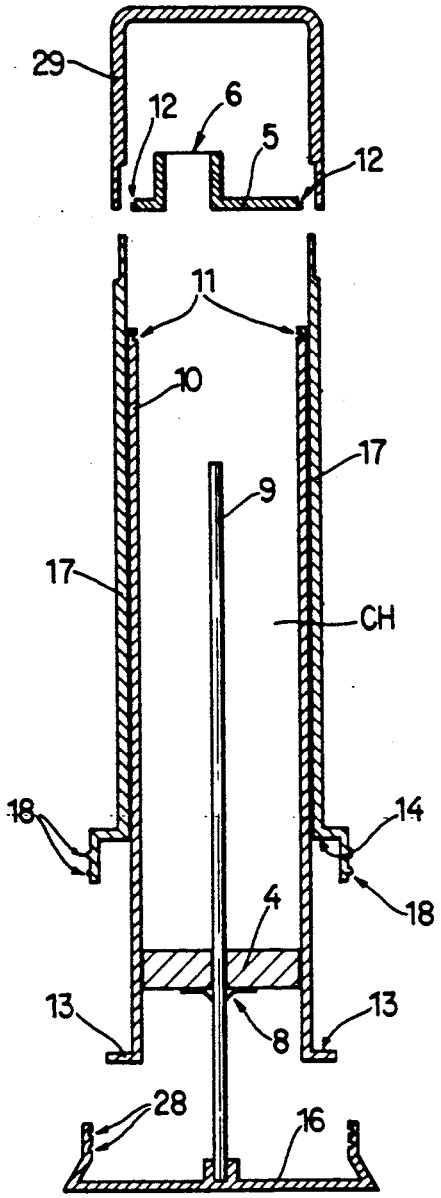
Fig. 2
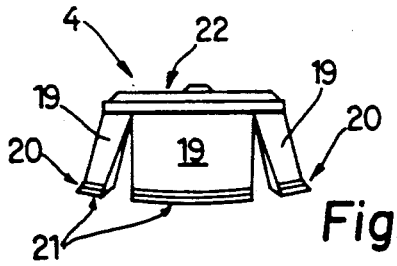
Fig. 3a
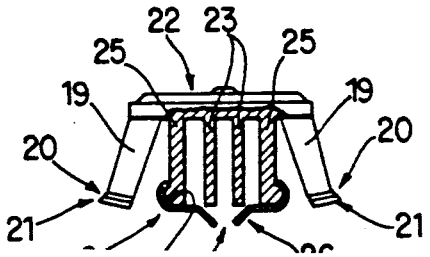
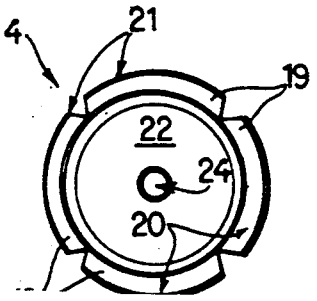

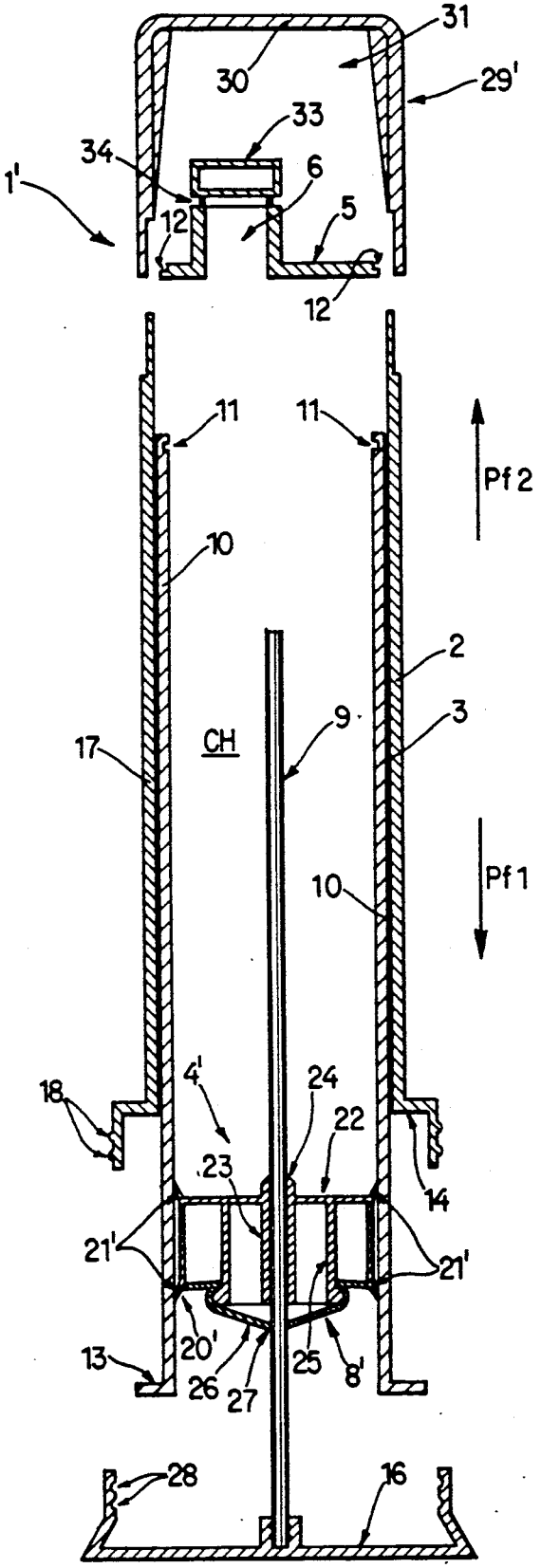
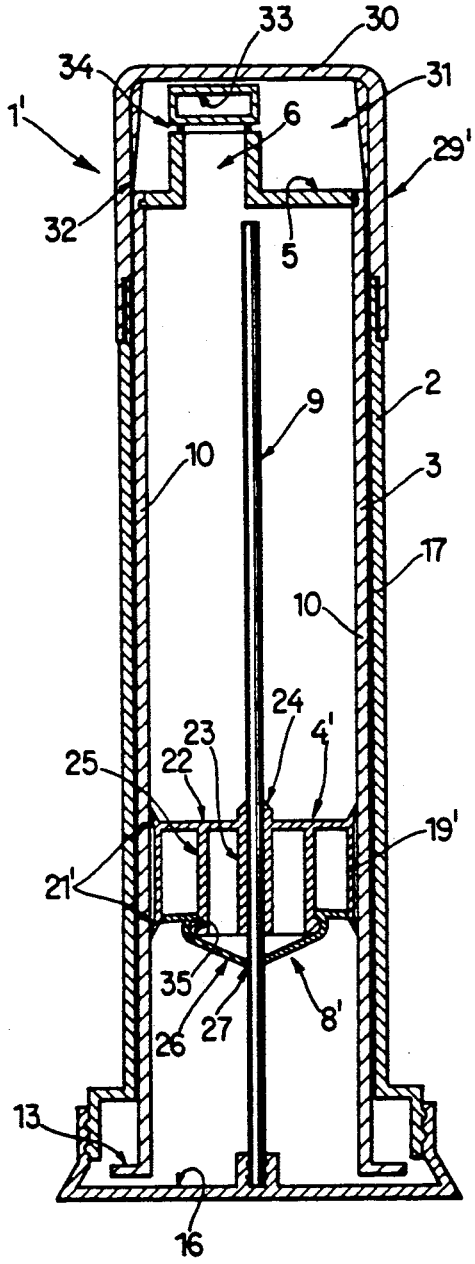
Fig. 5

DISPENSER FOR VISCOUS MATERIALS

BACKGROUND OF THE INVENTION

The invention relates to improvements in dispensers for pastes, creams and other viscous or highly viscous materials. More particularly, the invention relates to improvements in dispensers of the type wherein a material-containing cylinder is reciprocable relative to a carrier (such as a tubular housing) and has an outlet for evacuation of material from its interior, and wherein a piston is movably installed in the cylinder so that it can move in a direction to reduce the effective volume of the material-confining chamber of the cylinder.

It is already known to design a dispenser of the above outlined character in such a way that an end wall of the cylinder moves toward the piston when the cylinder is moved with reference to the housing in a direction to expel material from the chamber, and that the piston shares the movement of the cylinder in opposite direction back to a starting position. The piston seals or nearly seals the cylinder at one end of the chamber. The housing carries a depressible actuator which can move the end wall of the cylinder toward the piston to thus ensure expulsion of a desired quantity of viscous material by way of the outlet. The housing further contains a spring which biases the cylinder and its end wall back to a starting position. The spring operates between the housing and a collar of the outlet to pull the cylinder to its starting position. The outlet is a tubular insert, i.e., a separately produced part, which is attached to the major part of the cylinder subsequent to insertion of the spring into the housing.

A drawback of the just described dispenser is that it comprises a large number of separately produced parts. In addition the dispenser is not reliable because the separately produced tubular insert which constitutes the outlet is likely to be separated from the major part of the cylinder. In order to reduce the likelihood of such separation, it is necessary to establish a highly reliable connection between the insert and the major part of the cylinder. Another drawback of the aforedescribed dispenser is that the cylinder is likely to jam, i.e., the spring cannot return the cylinder to its starting position if some of the confined viscous material happens to penetrate between the housing and the cylinder. Moreover, the movement of the cylinder back to its starting position is slow, especially if viscous material is permitted to penetrate between the cylinder and its housing. The spring is likely to lose its resiliency after a certain period of use or on prolonged storage of the dispenser. The bias of the spring cannot be increased at will because a strong or very strong spring would be even more likely to extract or otherwise separate the tubular insert from the major part of the cylinder, i.e., it is not possible to ensure a predictable and reasonably rapid return movement of the cylinder to its starting position by employing a spring which can invariably overcome the resistance of viscous material between the cylinder and the housing. Last but not least, the operator of the dispenser must overcome the bias of the spring whenever the actuator is depressed for the purpose of ensuring that the end wall of the cylinder will cooperate with the piston and expel a desired quantity of material from the chamber.

U.S. Pat. No. 4,479,592 to Rusing et al. discloses a modified dispenser wherein the bottom wall of a tubular housing for the cylinder carries an elongated guide for the piston and the piston carries a spring which cooperates with the cylinder to prevent the piston and the cylinder from moving relative to each other in a direction to enlarge the effective volume of the material confining chamber in the cylinder. An end wall of the cylinder extends from the housing and can be depressed to move toward the piston in order to expel a desired quantity of viscous material from the chamber. A compression spring in the housing serves to return the cylinder to an extended position in which the end wall is ready to be depressed again in order to expel viscous material from the interior of the cylinder by way of an outlet in the end wall. A stop is provided to limit the extent of movement of the cylinder under the action of the spring.

The dispenser of Rusing et al. exhibits the drawback that the compression spring occupies a substantial amount of space in the interior of the housing. This shortens the stroke of the cylinder in a direction to expel viscous material. In addition, the person in charge of expelling viscous material by way of the outlet in the end wall of the cylinder must overcome the resistance of the compression spring. Still further, the likelihood of jamming of the cylinder in the housing is ever present.

OBJECTS OF THE INVENTION

An object of the invention is to provide a simple and inexpensive dispenser for viscous materials.

Another object of the invention is to provide a dispenser which can be operated to discharge small, medium large or large quantities of confined material.

A further object of the invention is to provide a dispenser which can be manipulated in response to exertion of a relatively small force.

An additional object of the invention is to provide a novel and improved piston for use in the above outlined dispenser.

Still another object of the invention is to provide a dispenser which can be loaded with viscous material without risking entrapment of air in the body of confined material.

A further object of the invention is to provide the dispenser with a novel and improved cylinder.

Another object of the invention is to provide a dispenser which can be mass-produced at a fraction of the cost of heretofore known dispensers for viscous materials.

An additional object of the invention is to provide a novel and improved housing for the cylinder of the above outlined dispenser.

SUMMARY OF THE INVENTION

The invention is embodied in a dispenser for creams, pastes and other viscous materials, particularly high viscous materials. The improved dispenser comprises a carrier and a cylinder which is movably mounted in the carrier and defines a material-confining chamber having a first end and a second end. The cylinder includes at least one material-discharging outlet which communicates with the chamber, and a wall member at one end of the chamber. The dispenser further comprises a piston which is movably installed in the cylinder at the other end of the chamber, and means for moving the cylinder relative to the carrier in a first direction to move the wall member toward the piston with resulting expulsion of viscous material from the chamber by way of the outlet and a reduction of the effective volume of the chamber, and in a second direction counter to the first direction to move the cylinder and the piston as a unit so that the effective volume of the chamber remains at least substantially unchanged during movement of the cylinder in the second direction. In accordance with a feature of the invention, the moving means is provided directly on the cylinder. The carrier preferably includes a housing having an open end through and beyond which the moving means extends, i.e., at least a portion of the moving means is accessible at the open end of the housing in each position of the cylinder relative to the housing.

The moving means can be integral with the cylinder. The latter further includes a tubular wall which surrounds the piston and the chamber. The aforementioned wall member and a portion of the tubular wall can constitute or form part of the moving means. For example, the wall member can be pressed in the first direction to cause expulsion of viscous material from the chamber, and the portion of the tubular wall can be pulled in the second direction to move the wall member back to its starting position.

The outlet can be provided in or on the wall member. Such wall member can be connected to and can seal an open end of the tubular wall of the cylinder. For example, the tubular wall of the cylinder can be provided with an internal groove in the region of the open end of the housing, and such groove receives a marginal portion of the wall member.

The cylinder and the housing are preferably provided with means for limiting the extent of movability of the cylinder in the first direction, in the second direction or in both direction. Such limiting means can comprise an external flange on the tubular wall of the cylinder and at least one stop on the housing. The flange is preferably remote from the wall member of the cylinder, and the stop is located in the path of movement of the flange during movement of the cylinder in the first or second direction.

In order to ensure that expulsion of viscous material from the chamber, or movement of the cylinder and piston in the second direction, will necessitate the exertion of a relatively small force, the internal surface of the housing and/or the external surface of the cylinder can be provided with friction reducing means. Such friction reducing means can include projections (e.g., axially parallel ribs) on the internal surface of the housing and/or on the external surface of the cylinder.

The housing comprises a tubular section which surrounds the tubular wall of the cylinder, and an end wall which cooperates with the tubular section to close and, if necessary, seal that end of the housing which is remote from its open end. This can be achieved by providing the tubular section with first detent means and by providing the end wall with complementary second detent means engaging the first detent means when the tubular section and the end wall are properly coupled to each other. The arrangement is or can be such that the first and second detent means more or less permanently secure the end wall to the respective end of the tubular section of the housing.

The piston can be provided with at least one sealing projection (e.g., an annular sealing lip) which engages the internal surface of the tubular wall of the cylinder. The lip can be a circumferentially complete annular sealing lip having an annular edge which abuts the internal surface of the tubular wall. Such lip can taper in a direction from the internal surface toward the axis of the cylinder.

The dispenser can further comprise an elongated guide which is affixed to the end wall of the housing and extends into the chamber by extending through a preferably axially disposed sleeve of the piston. The latter can comprise a bottom wall having a first side facing the respective end of the chamber and a second side, and the sleeve preferably extends from the second side of the bottom wall. The bottom wall of the piston has an opening for the guide.

The piston can be provided with a tubular portion which surrounds the sleeve for the guide with a certain amount of clearance and serves as a support for a resilient element which can constitute or resemble a diaphragm spring serving to engage the guide in order to prevent movements of the piston in the first direction, i.e., to ensure that when moved in the first direction the wall member of the cylinder will move toward the piston so that the wall member and the piston cooperate in expelling viscous material from the chamber by way of the outlet in the wall member. The resilient element can be dimensioned and mounted in such a way that it biases the skirt of the piston against the internal surface of the tubular wall of the cylinder. The skirt can have a sealing lip at that axial end which is remote from the bottom wall of the piston, and the resilient element can be mounted to bias such lip against the internal surface of the tubular wall of the cylinder. The skirt of the piston can carry several sealing lips, for example, a first sealing lip which is particularly effective when the cylinder moves in the first direction and a second sealing lip which is particularly effective when the cylinder moves in the second direction. The skirt of the piston can consist of several resilient arcuate sections which urge their sealing lips into engagement with the internal surface of the tubular wall. This renders it possible to employ a smaller resilient element because the latter need not bias the skirt against the tubular wall of the cylinder. The resilient element and the piston can be provided with complementary detent means (e.g., an annular bead on the aforementioned sleeve of the piston and a convex annular portion of the resilient element) to secure the resilient element to the piston in such position that the resilient element prevents the piston from moving relative to the guide in the first direction.

The dispenser can be provided with a detachable cap for concealment of the moving means. The cylinder and/or the housing can be provided with means for releasably holding the cap. For example, the cap can be provided with an internal conical surface which frictionally engages the tubular wall of the cylinder in the region of the wall member.

The tubular wall and the wall member can be said to constitute a main or major portion of the cylinder, and the latter can further comprise a closure which seals the outlet and is integral with the main portion. Such cylinder preferably further comprises a weakened (e.g., grooved) portion between the main portion and the closure to permit ready separation of the closure (e.g., by breaking or by cutting off) in order to expose the outlet and to permit expulsion of material from the chamber of the cylinder when the latter is caused to move in the first direction.

The cylinder can be provided with an extension which projects in a direction away from the chamber for viscous material beyond the open end of the housing. The outlet can be provided in the extension. An advantage of such dispenser is that the entire tubular wall and also the wall member of the cylinder can be confined in the housing, at least in certain positions of the cylinder and housing relative to each other.

The novel features which are considered as characteristic of the invention are set forth in particular in the appended claims. The improved dispenser itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a central longitudinal sectional view of a dispenser which embodies one form of the invention;

FIG. 2 is a partly exploded view of the dispenser which is shown in FIG. 1;

FIG. 3*a* is an elevational view of the piston in the dispenser of FIGS. 1 and 2;

FIG. 3*b* is a similar view of the piston with a portion of its skirt broken away and with its sleeve and tubular portion shown in an axial sectional view;

FIG. 3*c* is a plan view of the piston;

FIG. 4 is a partly exploded central longitudinal sectional view of a modified dispenser; and FIG. 5 is a central longitudinal sectional view of the modified dispenser in assembled condition.

DESCRIPTION OF PREFERRED EMBODIMENTS

FIGS. 1 and 2 show a dispenser 1 for pastes, creams and other viscous materials, especially highly viscous materials. The improved dispenser comprises an elongated cylindrical housing 2 which constitutes a carrier for a reciprocable cylinder 3 and can detachably support a cap 29. The tubular wall 10 of the cylinder 3 extends in part beyond the open end of the housing 2 and surrounds a piston 4 (shown schematically in FIGS. 1 and 2) at one axial end of a material-confining chamber CH the other axial end of which is bounded by a transversely extending wall member 5 having an outlet 6 for viscous material. The diameter of the piston 4 is selected in such a way that the piston at least substantially seals the respective end of the chamber CH from the interior 15 of the housing 2.

The chamber CH is filled with a viscous material all the way between the piston 4 and the wall member 5. If the wall member 5 is moved toward the bottom end wall 16 of the housing 2, the piston 4 is held against movement in such direction by a specially designed resilient element 8 which operates between the piston and an elongated rod-shaped guide 9 which is coaxial with the tubular wall 10 of the cylinder 3, which is affixed to the bottom end wall 16, and which extends through the spring 8 and piston 4 into the chamber CH. While it advances in the direction of arrow Pf1, the wall member 5 subjects the confined material to pressure because the piston 4 cannot move in such direction whereby a certain amount of material leaves the chamber CH by way of the outlet 6. At such time, the cap 29 is detached and exposes the wall member 5, the outlet 6 and the adjacent end portion of the tubular wall 10 of the cylinder 3. Such exposed end portion of the tubular wall 10 constitutes a first portion, and the wall member 5 constitutes a second portion, of a means for moving the cylinder 3 in directions which are indicated by arrows Pf1 and Pf2. When the exposed end portion of the tubular wall 10 is pulled by one hand in the direction of arrow Pf2 while the other hand holds the housing 2, the piston 4 shares the movement of the wall member 5 so that the effective volume of the chamber CH remains unchanged. In other words, the effective volume of the chamber CH is reduced by the amount of expelled viscous material when the wall member 5 is pushed in the direction of arrow Pf1, but the effective volume of the chamber CH remains unchanged when the exposed end portion of the tubular wall 10 is pulled in the direction of arrow Pf2 while the housing 2 is held against such movement. This ensures that the chamber CH is invariably filled with viscous material until the supply of such material is exhausted, i.e., until the effective volume of the chamber is reduced to zero. Friction between the peripheral surface of the piston 4 and the internal surface of the tubular wall 10 is sufficiently pronounced to overcome the resistance of the resilient element 8 in order to ensure that the piston 4 will share the movement of the cylinder 3 and its wall member 5 in the direction of arrow Pf2. The resistance of the resilient element 8 to movement of the piston 4 along the guide 9 in the direction of arrow Pf2 is minimal or negligible in view of the special configuration and mounting of this resilient element.

The feature that the means (5 and 10) for moving the cylinder 3 in directions which are indicated by arrows Pf1 and Pf2 is directly connected with and, in the embodiment of FIGS. 1 and 2, is an integral part of the cylinder contributes to simplicity, compactness, reliability and lower cost of the entire dispenser 1. Moreover, the aforediscussed compression spring or extension spring which is necessary in conventional dispensers to push the piston toward the outlet of the cylinder can be omitted because the exposed end portion of the tubular wall 10 constitutes a means for moving (pulling) the cylinder 3 (and hence the piston 4) in the direction of arrow Pf2. The means for moving the cylinder 3 in the direction of arrow Pf1 with reference to the piston 4 and housing 2 includes or constitutes the wall member 5. The latter can be provided with a protuberance 7 (indicated by broken lines) resembling a button or a knob which can be pressed with one finger to move the cylinder 3 in the direction of arrow Pf1. It is clear that, if desired, the exposed end portion of the tubular wall 10 can be used also as a means for moving the cylinder 3 in the direction of arrow Pf1.

The tubular wall 10 of the cylinder 3 can be provided with graduations (not specifically shown) to indicate the extent to which the end portion of the tubular wall 10 extends beyond the open end of the housing 2. This enables the operator to cause the outlet 6 to discharge metered quantities of viscous material during next-following depression of the cylinder 3 deeper into the housing 2. Of course, the cylinder 3 need not always perform a maximum stroke in the direction of arrow Pf1; the operator of the dispenser 1 simply observes the amount of viscous material which has already been discharged via outlet 6 and terminates the movement of the wall member 5 toward the piston 4 when the expelled quantity suffices for a particular purpose, e.g., to apply a cream to the face or to another part of the body of a person.

When the wall member 5 is moved toward the piston 4, the person using the dispenser 1 must overcome only the resistance which the viscous material offers to flow through and out of the outlet 6, i.e., it is not necessary to overcome the resistance of a stressed spring, so that the manipulation of the dispenser in a sense to discharge a selected quantity of viscous material necessitates the exertion of a small force. Moreover, and since the resistance of the wall member 5 to movement toward the piston 4 is relatively small (it depends primarily on the viscosity of the confined material and on the dimension of the outlet 6), it is not difficult to accurately meter the quantity of expelled material, i.e., the movement of the wall member 5 can be interrupted or terminated any desired stage between the fully extended and fully depressed positions of the cylinder 3.

FIG. 2 shows the dispenser 1 in dismantled condition except that a portion of the tubular wall 10 of the cylinder 3 still extends into the tubular section 17 of the housing 2 and that the piston 4 is still mounted on the guide 9 and is still surrounded by the tubular wall 10. In order to facilitate admission of a supply of viscous material into the cylinder chamber CH, the wall member 5 is detachable from the adjacent end portion of the tubular wall 10. The latter is provided with an internal groove 11 which can receive the marginal portion 12 of the wall member 5 with snap action or otherwise so as to establish a reliable connection between the wall member 5 and the tubular wall 10 as well as to seal the respective end of the chamber CH The other end of the chamber C is adjacent the piston 4. Once the marginal portion 12 is properly received in the groove 11, the wall member 5 is practically inseparably affixed to and reliably seals the respective end or portion of the tubular wall 10. Moreover, the connection between the wall member 5 and the tubular wall 10 is sufficiently reliable to resist the pressures which develop in the chamber CH when the wall member 5 is caused to move toward the piston 4 in order to expel viscous material by way of the outlet 6.

That end portion of the tubular wall 10 which is remote from the wall member 5 is provided with a radially outwardly extending annular flange 13 constituting one element of a means for limiting the extent of movability of the housing 2 and cylinder 3 relative to each other in directions which are indicated by the arrows Pf1 and Pf2. The limiting means further comprises an internal surface or stop 14 of the housing 2 at the respective end of the tubular section 17 of the housing, and the bottom end wall 16 of the housing. The bottom end wall 16 has a short cylindrical extension which is provided with female detent elements 28 in the form of circumferentially extending internal grooves complementary to male detent elements in the form of circumferentially complete ribs or beads 18 at the exterior of a larger-diameter extension of the tubular section 17. The extension with the male detent elements 18 extends beyond the internal surface 14 and can be slipped into the extension of the bottom end wall 16 so that the detent elements 18 penetrate into the detent elements 28 and ensure a highly reliable retention of the bottom end wall 16 on the tubular section 17. As can be seen in FIG. 1, the maximum stroke of the cylinder 3 relative to the housing 2 and vice versa is determined by the distance of the internal surface or stop 14 from the inner side of the disc-shaped main portion or stop of the bottom end wall 16. The surface 14 cooperates with the flange 13 to determine the maximum extent of movability of the cylinder 3 relative to the housing 2 in the direction of arrow Pf2, and the flange 13 cooperates with the bottom end wall 16 to determine the maximum extent of movability of the cylinder 3 relative to the housing 2 in the direction of arrow Pf1. The detent elements 18, 28 can be designed to ensure that the bottom end wall 16 is more or less permanently (i.e., practically inseparably) secured to the tubular section 17 of the housing 2.

FIGS. 1 and 2 show that the resilient element 8 acts only upon the guide 9, i.e., that it does not come in contact with the internal surface of tubular wall 10 of the cylinder 3.

The details of a piston 4 which can be used with advantage in the dispenser 1 of FIGS. 1 and 2 are shown in FIGS. *3a*, *3b* and *3c*. This piston comprises an end wall or bottom wall 22 and a composite skirt including four resilient arcuate sections 19 which are integral with the marginal portion of the end wall 22 and tend to spread radially outwardly so that the lips 21 at their rims 20 bear against the internal surface of the tubular wall 10 when the piston 4 is inserted into the cylinder 3. The lips 21 together form a composite annular lip which is remote from the end wall 22 of the piston 4. Each of the four sections 19 of the skirt extends along an arc of approximately 90 degrees. Each lip 21 has a relatively sharp edge and each such lip slopes radially outwardly and in a direction away from the end wall 22. The edges of the lips 21 can even penetrate (preferably only slightly) into the internal surface of the tubular wall 10 to thus ensure that the piston 4 cannot move in the direction of arrow Pf1 when the pressure of confined viscous material in the chamber CH upon the end wall 22 of the piston 4 is increased as a result of movement of the wall member 5 toward the piston. At such time, the lips 21 of the rims 20 act not unlike hooks and reliably hold the piston 4 against movement in the direction of arrow Pf1. Friction between the lips 21 and the internal surface of the tubular wall 10 suffices to ensure that the piston 4 slides along the guide 9 in a direction away from the bottom wall 16 of the housing 2 when the operator pulls the cylinder 3 in the direction of arrow Pf2.

The piston 4 of FIGS. *3a* to *3c* further comprises a substantially centrally located sleeve-like tubular portion 23 (hereinafter called sleeve) extending from that side of the end wall 22 which faces away from the chamber CH and surrounding the adjacent portion of the guide 9. The latter extends through a central opening 24 of the end wall 22 and into the chamber CH when the dispenser 1 is fully assembled.

The piston 4 further comprises a second sleeve-like tubular portion 25 which spacedly surrounds the sleeve 23 and serves as a support for the resilient element 8. The free end of the tubular portion 25 has a bead 35 constituting a male detent element which cooperates with a complementary female detent element of the resilient element 8. The latter has a circular central aperture 27 surrounded by a frustoconical portion 26 which extends radially inwardly from the bead 35 in a direction away from the end wall 22 and engages the peripheral surface of the guide 9, at such an angle that it reliably opposes any movement of the resilient element 8 and piston 4 relative to the guide 9 in a direction toward the bottom end wall 16 of the housing 2. The guide 9 extends through the aperture 27 of the conical portion 26 of resilient element 8. The conical portion 26 offers little resistance to movement of the resilient element 8 and piston 4 in the direction of arrow Pf2, i.e., friction between the lips 21 on the rims 20 of resilient sections 19 of the skirt of the piston 4 and the internal surface of the tubular wall 10 suffices to ensure that the piston 4 shares the movements of the cylinder 3 in the direction of arrow Pf2 and thus slides along the guide 9 in a direction away from the bottom wall 16 to ensure that the effective volume of the chamber CH remains unchanged when the cylinder 3 is caused to move in the direction of arrow Pf2.

An advantage of the improved dispenser 1 is its simplicity. Moreover, the operation of the dispenser is very reliable because it need not employ any resilient means for biasing the piston 4 and/or the cylinder 3 in the direction of arrow Pf2. In addition, the means for moving the cylinder 3 are directly connected to and are preferably integral with the cylinder to thus further reduce the number of separately produced parts. Still further, it is not necessary to provide a separately produced outlet and/or a channel or passage between the housing 2 and cylinder 3 and/or separately produced knobs, pushbuttons or like parts which are standard components of conventional dispensers.

When the dispensing of a quantity of viscous material is completed, e.g., when the wall member 5 has been used to move the flange 13 of the tubular wall 10 of the cylinder 3 all the way into engagement with the bottom end wall 16 of the housing 2, the exposed end portion of the tubular wall 10 can be grasped to move the cylinder all the way to the end position of FIG. 1 (in which the flange 13 abuts the shoulder or stop 14) or to any one of a practically infinite number of intermediate positions, depending on the quantity of viscous material which is to be expelled from the chamber CH in response to renewed movement of the wall member 5 in the direction of arrow Pf1. In this manner, the operator of the dispenser 1 can select any desired quantity of viscous material for expulsion from the chamber CH by way of the outlet 6, including a large or very large quantity in response to movement of the flange 13 all the way from the stop 14 into engagement with the bottom end wall 16 of the housing 2.

If desired, the wall member 5 and/or the adjacent end portion of the tubular wall 10 can be provided with indicia (e.g., different coloring, special profiling, arrows or the like) to pinpoint to the user the means for moving the cylinder 3 in the directions of arrows Pf1 and Pf2.

It has been found that the chamber CH can be filled with viscous material in a very convenient way if the piston 4 is slipped onto the guide 9 and the cylinder 3 is inserted into the housing 2 (so that the flange 13 is located between the stop 14 and the bottom end wall 16) prior to admission of viscous material by way of the still open end of the tubular wall 10. This greatly reduces the likelihood of entrapment of air in the chamber CH. The last step the involves insertion of the marginal portion 12 of the wall member 5 into the groove 11 of the tubular wall 10 to reliably and sealingly secure the wall member 5 to the tubular wall 10, i.e., the marginal portion 12 will remain in the groove 11 when the wall member 5 is pressed in the direction of arrow Pf1 to move toward the piston 4 which is held against movement toward the bottom end wall 16 because the conical portion 26 of the resilient element 8 engages the peripheral surface of the guide 9 with a force which is greater than that of friction between the lips 21 on the sections 19 of the skirt of the piston 4 and the internal surface of the tubular wall 10.

The aforediscussed friction reducing means between the tubular section 17 of the housing 2 and the tubular wall 10 of the cylinder 3 constitute an optional but desirable feature of the dispenser 1. If the friction reducing means includes axially parallel ribs, such ribs are preferably equidistant from each other in the circumferential direction of the tubular wall 10. The ribs need not be provided along the entire external surface of the tubular wall 10 and/or along the entire internal surface of the tubular section 17. For example, the ribs can be provided along that part of the external surface of the tubular wall 10 which is confined in the section 17 when the flange 13 abuts the bottom end wall 16 of the housing 2.

The sleeve 23 of the piston 4 also constitutes an optional but desirable feature of the dispenser 1, and more specifically of its piston 4. This sleeve reduces the likelihood of jamming of the piston 4 relative to the guide 9 and/or relative to the tubular wall 10. In addition, the sleeve 23 reduces the likelihood of penetration of viscous material from the chamber CH into the space 15 between the piston 4 and the bottom end wall 16 when the wall member 5 is caused to advance in the direction of arrow Pf1 to expel viscous material from the chamber CH by way of the outlet 6.

The conical portion 26 of the resilient element 8 can be mounted directly on the sleeve 23 of the piston 4. However, it is presently preferred to mount the conical portion 26 on the tubular portion 25 which spacedly surrounds the sleeve 23. This ensures that the conical portion 26 cannot cause the sleeve 23 to bear against the peripheral surface of the guide 9 with force which would prevent the piston 4 from sharing the movement of the cylinder 3 in the direction of arrow Pf2, i.e., the tubular portion 25 reduces the likelihood of excessive frictional engagement between the piston 4 and the guide 9 such as could prevent friction between the sealing lips 21 and the internal surface of the tubular wall 10 from ensuring that the piston will share the movement of the wall member 5 in a direction away from the bottom end wall 16 of the housing 2. Moreover, the just described mounting of the resilient element 8 on the tubular portion 25, rather than on the sleeve 23, of the piston 4 ensures that a relatively small force is required to pull the cylinder 3 in the direction of arrow Pf2.

The resilient element 8 could be replaced with a larger resilient element which would bias the lips 21 of the four sections 19 of the skirt of the piston 4 against the internal surface of the tubular wall 10 (see FIGS. 4 and 5). It has been found that such relatively large and more expensive resilient element is not necessary if the sections 19 exhibit a rather pronounced tendency to move their sealing lips 21 radially outwardly toward and into frictional engagement with the internal surface of the tubular wall 10. All that is necessary is to use a relatively small resilient element 8 which operates only between the piston 4 and the guide 9 to ensure that the piston is prevented from moving in a direction toward the bottom end wall 16 of the housing 2.

While it is within the purview of the invention to provide a non-separable connection between the piston 4 and the resilient element 8, e.g., by welding or by resorting to a suitable adhesive, a reliable detent structure between this spring and the piston normally suffices to ensure that such parts cannot become separated irrespective of whether the wall member 5 is pushed in the direction of arrow Pf1 or the tubular wall 10 is pulled in the direction of arrow Pf2. The absence of need for a bond (either by means of an adhesive or by welding) contributes to lower cost of the dispenser. A pronounced form-locking connection between the bead 35 and the adjacent concave portion of the resilient element 8 suffices to ensure that the latter follows the piston 4 and the tubular wall 10 during movement of the flange 13 away from the bottom end wall 16.

FIGS. 4 and 5 show a modified dispenser 1'. All such parts of this dispenser which are identical with or clearly analogous to corresponding parts of the dispenser 1 of FIGS. 1 and 2 are denoted by similar reference characters. The wall member 5 of the cylinder 3 again serves as a means for moving the cylinder in the direction of arrow Pf1, and the exposed or accessible end portion of the tubular wall 10 serves as a means for pulling the cylinder in the direction of arrow Pf2. The piston 4' differs from the piston 4 of FIGS. 3*a* to 3*c* in that it comprises a one-piece skirt 19'. Moreover, the piston 4' has two circumferentially complete one-piece annular sealing lips 21' one of which is adjacent the end wall 22 and the other of which is adjacent the resilient element 8'. The sharp edge of the lower lip 21' of FIGS. 4 and 5 slopes toward the bottom end wall 16, and the sharp edge of the upper lip 21' slopes toward the wall member 5. The lower lip 21' at the free end of the skirt 19' (i.e., at that end which is remote from the end wall 22) is biased radially outwardly by a portion of the resilient element 8' so that it bears against the internal surface of the tubular wall 10 with a substantial force. This ensures that the piston 4' is compelled to share the movements of the cylinder 3 in the direction of arrow Pf2, i.e., that the piston 4' then moves relative to the guide 9. On the other hand, the conical central portion 26 of the resilient element 8' positively prevents any movements of the piston 4' relative to the guide 9 in the direction of arrow Pf1, the same as in the dispenser 1 when the latter employs the piston 4 and resilient element 8 of FIGS. 3*a* to 3*c*.

The resilient element 8' can be said to be an integral part of the piston 4' because the bead 35 and the adjacent concave portion of the resilient element establish a more or less permanent connection between 4' and 8'. This resilient element is different from springs which are used in conventional dispensers because it operates only between the piston 4' and the guide 9, i.e., it does not come in direct engagement with the tubular wall 10 of the cylinder 3. The guide 9 extends through the circular central aperture 27 of the conical portion 26 of the resilient element 8', the same as described with reference to FIGS. 3*a* to 3*c*.

The lower lip 21' of FIGS. 4 and 5 can form an integral part of the rim 20' of the skirt 19' of piston 4'.

If desired or necessary, the internal surface of the tubular wall 10 of the cylinder 3 can be roughened or profiled to establish a more reliable frictional engagement with the lips 21 or 21' and to even further reduce the likelihood of movement of the cylinder 3 relative to the piston 4 or 4' when the tubular wall 10 is pulled in the direction of arrow Pf2.

The cap 29' of the dispenser 1' has an internal space 31 which is surrounded by a conical surface tapering toward the bottom end wall 30 of the cap. The conical surface engages with a certain amount of friction the exposed end portion 32 of the tubular wall 10 in the region of the wall member 5 when the cap 29' is properly applied to the cylinder 3 to close the open end of the housing 2 when the dispenser 1' is not in use. Frictional engagement between the conical internal surface of the cap 29' and the portion 32 of tubular wall 10 can be sufficiently pronounced to ensure that the cylinder 3 is pulled in the direction of arrow Pf2 (until the flange 13 engages the internal surface or stop 14) while the user pulls the cap 29' in the direction of arrow Pf2 in order to detach the cap from the tubular wall 10. The dispenser 1' is then ready for use because depression of the wall member 5 in the direction of arrow Pf1 immediately results in expulsion of viscous material from the chamber CH by way of the outlet 6.

When the dispenser 1' is filled with viscous material, the outlet 6 of the wall member 5 is sealed by an integral closure 33 which is confined in the internal space 31 of the cap 29' The closure 33 is integrally connected to the main or major portion of the cylinder 3 (such main portion includes the wall member 5 and the tubular wall 10) by a weakened portion 34 which can be broken off or cut off to permit viscous material to escape via outlet 6 when the wall member 5 is pushed in the direction of arrow Pf1. The closure 33 prevents accidental escape of viscous material from the chamber CH via outlet 6 in storage and/or during shipment of the dispenser 1'.

All parts of the dispenser 1 or 1' (with the possible exception of the normally metallic spring 8 or 8') can be made of a suitable plastic material.

The operation of the dispenser 1' is substantially identical to that of the dispenser 1 except that, if the cap 29 of FIGS. 1 and 2 is not designed to frictionally engage the adjacent end portion of the tubular wall 10, detachment of the cap 29 from the housing 2 of the dispenser 1 does not automatically entail at least some movement of the cylinder 3 of FIGS. 1 and 2 in the direction of arrow Pf2. On the other hand, when the user of the dispenser 1' detaches the cap 29' from the housing 2, such detachment can result in a movement of the flange 13 of the tubular wall 10 of the cylinder 3 of FIGS. 4 and 5 all the way into engagement with the internal surface 14 or stop of the housing 2 so that the dispenser 1' is ready to discharge a metered maximum quantity or a smaller quantity of viscous material as soon as the wall member 5 is thereupon depressed in order to move the flange 13 away from the surface or stop 14, for example, all the way into engagement with the bottom end wall 16 of the housing 2. Of course, the closure 33 must be cut or broken off at 34 before the outlet 6 can discharge viscous material. The length of the outlet 6 need not exceed 10 mm; this is desirable and advantageous because such relatively short outlet offers little resistance to the flow of viscous material from the chamber CH while the wall member 5 is caused to move toward the piston 4'.

Each of the dispensers 1 and 1' exhibits the additional advantage that the cylinder 3 can be designed to confine a relatively large quantity of viscous material. This is due to the fact that the housing 2 need not contain a coil spring or any other means for biasing the piston against viscous material in the chamber CH. Therefore, the cylinder 3 can occupy practically the entire internal space of the housing 2. Another reason for the possibility of using a relatively large cylinder (and hence a large chamber for viscous material) is that the wall member 5 constitutes a means for moving the cylinder toward the bottom end wall 16 of the housing 2, i.e., the cylinder and/or the housing need not be provided with any separately produced actuator means for moving the cylinder in the direction of arrow Pf1. Such actuator means could take up space beneath the cap 29 or 29'.

As already explained above, the chamber CH of the cylinder 3 can be filled with viscous material upon insertion of the piston 4 or 4' into the tubular wall 10 and prior to insertion of marginal portion 12 of the wall member 5 into the internal groove 11 of the wall 10.

Such mode of filling the chamber CH reduces the likelihood of entrapment of air in the viscous material. Air can also escape by way of the opening 24 if the piston 4 or 4' is not slipped onto the guide 9 prior to admission of viscous material into the chamber CH.

It is further within the purview of the invention to modify the dispenser 1 or 1' by providing the wall member 5 with a relatively long extension (e.g., an extension projecting well beyond the open end of the outlet 6 and replacing or being provided in addition to the knob 7). This renders it possible to fully conceal the tubular wall 10 and the wall member 5 of the cylinder 3 in the housing 2 (at least when the flange 13 abuts the bottom end wall 16), as long as the aforementioned extension projects beyond the open end of the housing 2 and can be readily grasped by hand to push the cylinder in the direction of arrow Pf1 or to pull the cylinder in the direction of arrow Pf2. In other words, the extension then constitutes a means for moving the cylinder for the purpose of expelling viscous material by way of the outlet 6 or for the purpose of returning the cylinder to its starting position by moving it in a direction away from the bottom end wall 16 of the housing 2. The outlet of such modified dispenser can be provided in the extension.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A dispenser for paste and other viscous materials, comprising a carrier including a housing having an open end; a cylinder movably mounted in and extending into said housing through said open end, said cylinder defining a material-confining chamber having a first end and a second end and said cylinder including a tubular wall surrounding said chamber and a wall member at said one end of said chamber, said wall member having at least one material-discharging outlet in communication with said chamber; a piston movably installed in said tubular wall at the other end of said chamber, said piston including a bottom wall adjacent said chamber and a skirt adjacent said tubular wall, said cylinder being movable relative to said housing in a first direction to move said wall member toward said piston with resulting expulsion of material from said chamber by way of said at lest one outlet and a reduction of the effective volume of said chamber, and in a second direction counter to said first direction; and means for coupling said cylinder with said piston for movement in said second direction so that the effective volume of the chamber remains at least substantiallly unchanged during joint movement of said cylinder and said piston in said second direction, said coupling means including resilient means for biasing said skirt against said tubular wall.

2. The dispenser of claim 1, wherein said wall member is integral with said tubular wall.

3. The dispenser of claim 1, wherein said tubular wall and said wall member are accessible to the hand of an operator to facilitate movements of said cylinder in said first and second directions.

4. The dispenser of claim 1, wherein said tubular wall has and open end and an internal groove in the region of said open end thereof and said wall member has a marginal portion received in said groove.

5. The dispenser of claim 1, wherein said skirt has an end portion remote from said bottom wall and provided with a sealing lip which is biased against said tubular wall.

6. The dispenser of claim 1, wherein said piston has at least one annular sealing lip which sealingly engages said tubular wall at least during movement of said cylinder in one of said directions.

7. The dispenser of claim 1, wherein said cylinder has a main portion which includes said wall member, and further comprising a closure for said at least one outlet, said closure being integral with said main portion and said cylinder having a weakened portion provided between said main portion and said closure to facilitate separation of said closure from the main portion to thus expose said at least one outlet.

8. The dispenser of claim 1, wherein said carrier includes an elongated guide for said piston, said guide extending through said piston and into said chamber and said coupling means comprising resilient means operating between said piston and said guide to prevent movement of the piston in said first direction, said piston and said resilient means having complementary detent means securing said resilient means to said piston.

9. The dispenser of claim 1, wherein said cylinder and said carrier comprise means for limiting the extent of movability of said cylinder in at least one of said directions.

10. The dispenser of claim 9, wherein said limiting means comprises an external flange on said cylinder and a stop on said carrier, said flange being remote from said wall member and said stop being located in the path of movement of said flange during movement of said cylinder in said at least one direction.

11. The dispenser of claim 1, wherein said carrier has an internal surface and said cylinder has an external surface surrounded by said internal surface, at least one of said surfaces having friction reducing means.

12. The dispenser of claim 11, wherein said friction reducing means includes projections on said at least one surface.

13. The dispenser of claim 1, wherein said housing has a second end remote from said open end thereof, said housing including a tubular section surrounding said cylinder and an end wall closing said second end thereof.

14. The dispenser of claim 13, further comprising complementary first and second detent means respectively provided on said tubular section and said end wall to substantially permanently secure said end wall to said tubular section.

15. The dispenser of claim 1, further comprising cap for said wall member, said cylinder having means for releasably holding said cap.

16. The dispenser of claim 15, wherein said cap has a conical internal surface which releasably engages said cylinder in the region of said wall member.

17. The dispenser of claim 1, wherein said cylinder includes an extension projecting in a direction away from said chamber.

18. The dispenser of claim 17, wherein said wall member includes a portion which defines said at least one outlet and forms part of said extension.

19. The dispenser of claim 1, wherein said tubular wall surrounds said chamber and said piston has an internal surface, said piston having at least one sealing projection engaging said internal surface.

20. The dispenser of claim 19, wherein said sealing projection includes an annular lip.

21. The dispenser of claim 20, wherein said at least one projection includes a circumferentially complete sealing lip having an annular edge abutting said internal surface, said lip tapering in a direction from said internal surface toward the axis of said cylinder.

22. The dispenser of claim 1, wherein said piston includes a sleeve which is substantially coaxial with said tubular wall and further comprising an elongated guide secured to said carrier outside of said chamber and extending into said chamber by way of said sleeve.

23. The dispenser of claim 22, wherein said bottom wall has a first side confronting said chamber and a second side facing away from said chamber, said sleeve being disposed at said second side of said bottom wall and said wall having an opening for said guide.

24. The dispenser of claim 22, wherein said piston said coupling means comprises a tubular portion surrounding said sleeve and further comprising resilient means mounted on said tubular portion and engaging said guide to hold said piston against movement in said first direction.

* * * * *